US010775129B1

(12) United States Patent
Kincel et al.

(10) Patent No.: US 10,775,129 B1
(45) Date of Patent: Sep. 15, 2020

(54) HANDGUARD MOUNT WITH TIE BAR

(71) Applicant: BRAVO COMPANY MFG, INC., Hartland, WI (US)

(72) Inventors: Eric Stephen Kincel, Coeur d'Alene, ID (US); Jeffrey James O'Brien, Coeur d'Alene, ID (US)

(73) Assignee: Bravo Company MFG, Inc., Hartland, WI (US)

( * ) Notice: Subject to any disclaimer, the term of this patent is extended or adjusted under 35 U.S.C. 154(b) by 0 days.

(21) Appl. No.: 16/578,048

(22) Filed: Sep. 20, 2019

(51) Int. Cl.
*F41C 23/16* (2006.01)
*F41A 5/20* (2006.01)

(52) U.S. Cl.
CPC ..... *F41C 23/16* (2013.01); *F41A 5/20* (2013.01)

(58) Field of Classification Search
CPC ..... F41C 23/16; F41C 23/00
See application file for complete search history.

(56) References Cited

U.S. PATENT DOCUMENTS 7,770,317 B1 8/2010 Tankersley
8,438,770 B2 5/2013 Troy
8,562,243 B2 * 10/2013 Dizdarevic ..... F16D 1/094 403/370
8,607,490 B1 12/2013 Zinser
8,739,448 B2 6/2014 Kimmel et al.
8,904,691 B1 * 12/2014 Kincel ..... F41C 23/16 42/71.01
9,389,043 B1 * 7/2016 Zhang ..... F41C 23/16
9,459,078 B1 * 10/2016 Kincel ..... F41G 11/004
9,464,865 B2 * 10/2016 Shea ..... F41C 23/16
9,528,793 B1 * 12/2016 Oglesby ..... F41C 23/16
9,599,429 B1 * 3/2017 Davis ..... F41C 23/14
9,702,652 B1 * 7/2017 Jackson ..... F41A 21/482
9,791,239 B1 * 10/2017 Kincel ..... F41C 23/16
10,126,095 B1 * 11/2018 Reid ..... F41C 23/16
10,352,650 B2 * 7/2019 Hiler, Jr. ..... F41C 23/16
10,436,549 B1 * 10/2019 Taylor ..... F41A 3/66
10,591,247 B2 * 3/2020 Hubbell ..... F41C 23/16
10,619,971 B2 * 4/2020 Hubbell ..... F41C 23/16
2010/0126054 A1 * 5/2010 Daniel ..... F41C 23/16 42/71.01
2011/0126443 A1 6/2011 Sirois
2011/0192066 A1 * 8/2011 Kimmel ..... F41C 23/16 42/71.01
2012/0124880 A1 5/2012 Leclair
2012/0186123 A1 7/2012 Troy et al.
(Continued)

FOREIGN PATENT DOCUMENTS

WO 2013/010515 A1 1/2013

*Primary Examiner* — Derrick R Morgan
(74) *Attorney, Agent, or Firm* — Michael Best & Friedrich LLP

(57) ABSTRACT

An assembly for mounting a handguard on a barrel nut of a firearm. The firearm has a gas piston action that includes an operating rod. The assembly includes a tie rod having a reduced thickness middle portion that extends between the barrel nut and the operating rod. The tie rod has connectors at each end. Fasteners are inserted from opposite sides of the handguard and connect to the tie rod connectors. The fasteners are threaded into clamp blocks such that rotation of the fasteners applies compression on the handguard against the barrel nut and a generates a reactive tensile load in the tie bar.

20 Claims, 8 Drawing Sheets

(56) References Cited

U.S. PATENT DOCUMENTS

| | | | | |
|---|---|---|---|---|
| 2013/0276342 | A1* | 10/2013 | Chvala | F41A 13/12 42/90 |
| 2014/0026459 | A1 | 1/2014 | Yan et al. | |
| 2014/0041273 | A1* | 2/2014 | Masters | F41C 23/16 42/71.01 |
| 2014/0130390 | A1* | 5/2014 | Geissele | F41C 23/16 42/71.01 |
| 2014/0196338 | A1* | 7/2014 | Lessard | F41A 35/02 42/16 |
| 2015/0316347 | A1* | 11/2015 | Shea | F41C 23/16 42/75.02 |
| 2016/0091276 | A1* | 3/2016 | Miller | F16B 39/04 42/75.02 |
| 2016/0169617 | A1* | 6/2016 | Daley, Jr. | F41C 23/16 42/71.01 |
| 2018/0202757 | A1* | 7/2018 | Samson | F41C 23/16 |
| 2018/0306551 | A1* | 10/2018 | Reid | F41A 3/66 |
| 2019/0101355 | A1* | 4/2019 | Hubbell | F41C 23/16 |
| 2019/0154396 | A1* | 5/2019 | Zinsner | F41A 11/02 |
| 2019/0162505 | A1* | 5/2019 | Mezynski | F41C 23/16 |
| 2019/0170476 | A1* | 6/2019 | Hiler, Jr. | F41A 21/482 |
| 2019/0226799 | A1* | 7/2019 | Hubbell | F41C 27/00 |
| 2019/0277598 | A1* | 9/2019 | Kincel | F41A 21/485 |

* cited by examiner

HANDGUARD MOUNT WITH TIE BAR

BACKGROUND

The present invention relates to a mounting system for a handguard on a firearm. The mounting system is particularly suitable for firearms having a gas piston action.

SUMMARY

In one embodiment, the invention provides a mounting assembly for a handguard mounted on a barrel nut of a firearm having a gas piston action that includes an operating rod, the handguard including a clamping surface engaging an outer surface of the barrel nut and defining a gap, the operating rod extending through the gap, the mounting assembly comprising: a tie rod extending along a clamping axis across the gap, the tie rod including a middle portion between the operating rod and the barrel nut, a first end defining a tie rod connector proximate a first side of the gap, and a second end secured to the handguard on a second side of the gap opposite the first side; a clamp block having an clamping surface engaging an outer surface of the handguard; and a fastener threaded into the clamp block and including a fastener connector engaging the tie rod connector, the engagement of the tie rod connector and fastener connector permitting relative rotation between the fastener and tie rod about the clamping axis but resisting relative movement between the fastener and tie rod along the clamping axis; wherein rotation of the fastener in the threaded bore draws the second end of the tie rod toward the clamp block to narrow the gap and clamp the clamping surface against the barrel nut.

In some configurations, the operating rod extends perpendicular to the tie rod; and the tie rod middle portion extends at least partially around a portion of the operating rod. In some configurations, the piston extends perpendicular to the tie rod; and the tie rod middle portion includes a reduced thickness portion to accommodate the piston. In some configurations, one of the tie rod connector and fastener connector includes a cup and the other of the tie rod connector and fastener connector includes a portion captured in the cup. In some configurations, a clamping force of the clamping surface against the barrel nut gives rise to a reactive tensile load on the tie rod. In some configurations, the fastener is threaded into the clamp block with left-hand threads. In some configurations, the fastener and clamp block are a respective first fastener and first clamp block, the mounting assembly further comprising a second fastener and second clamp block for securing the second end of the tie rod to the handguard on the second side of the gap.

In another embodiment, the invention provides a handguard assembly for a firearm having a barrel nut and an operating rod for cycling an action of the firearm, the handguard assembly comprising: a handguard including a clamping surface engaging a majority of an outer circumference of the barrel nut and defining a gap through which the operating rod extends; a tie rod extending along a clamping axis across the gap, the tie rod including a middle portion between the operating rod and the barrel nut, a first end defining a tie rod connector proximate a first side of the gap, and a second end secured to the handguard on a second side of the gap opposite the first side; a clamp block having an clamping surface engaging an outer surface of the handguard; and a fastener threaded into the clamp block and including a fastener connector engaging the tie rod connector, the engagement of the tie rod connector and fastener connector permitting relative rotation between the fastener and tie rod about the clamping axis but resisting relative movement between the fastener and tie rod along the clamping axis; wherein rotation of the fastener in the threaded bore draws the second end of the tie rod toward the clamp block to narrow the gap and clamp the clamping surface against the barrel nut.

In some configurations, the operating rod extends perpendicular to the tie rod; and the tie rod middle portion extends at least partially around a portion of the operating rod. In some configurations, the operating rod extends perpendicular to the tie rod; and the tie rod middle portion includes a reduced thickness portion to accommodate the operating rod. In some configurations, one of the tie rod connector and fastener connector includes a cup and the other of the tie rod connector and fastener connector includes a portion captured in the cup. In some configurations, a clamping force of the clamping surface against the barrel nut gives rise to a reactive tensile load on the tie rod. In some configurations, the fastener is threaded into the clamp block with left-hand threads. In some configurations, the fastener and clamp block are a respective first fastener and first clamp block, the mounting assembly further comprising a second fastener and second clamp block for securing the second end of the tie rod to the handguard on the second side of the gap.

In another embodiment, the invention provides a method for mounting a handguard assembly to a firearm having a barrel nut and an operating rod for cycling an action of the firearm, the method comprising the steps of: positioning a clamping surface of the handguard assembly against an outer circumference of the barrel nut and defining a gap through which the operating rod extends; extending a tie rod along a clamping axis across the gap with a middle portion of the tie rod between the operating rod and the barrel nut; defining a tie rod connector at a first end of the tie rod and proximate a first side of the gap; securing a second end of the tie rod to a second side of the gap opposite the first side; positioning a clamp block against an outer surface of the handguard adjacent the first side of the gap; threading a fastener into the clamp block, the fastener including a fastener connector engaging the tie rod connector to permit relative rotation between the fastener and tie rod about the clamping axis but resist relative movement between the fastener and tie rod along the clamping axis; and in response to rotation of the fastener in the threaded bore, drawing the second end of the tie rod toward the clamp block to narrow the gap and clamp the clamping surface against the barrel nut.

In some configurations, the operating rod extends perpendicular to the tie rod, the step of extending the tie rod including extending a middle portion at least partially around a portion of the operating rod. In some configurations, one of the tie rod connector and fastener connector includes a cup and the other of the tie rod connector and fastener connector includes a portion captured in the cup; the step of threading a fastener into the clamp block including engaging the cup with the portion captured in the cup. In some configurations, the method further comprises the step of generating a reactive tensile load on the tie rod in response to drawing the second end of the tie rod toward the clamp block, and maintaining a clamping force of the clamping surface against the barrel nut by bearing the tensile load with the tie rod. In some configurations, the step of threading a fastener comprises threading the fastener into the clamp block with left-hand threads. In some configurations, the method further comprises the steps of securing the second end of the tie rod to the handguard on the second side of the gap with a second fastener and second clamp block.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
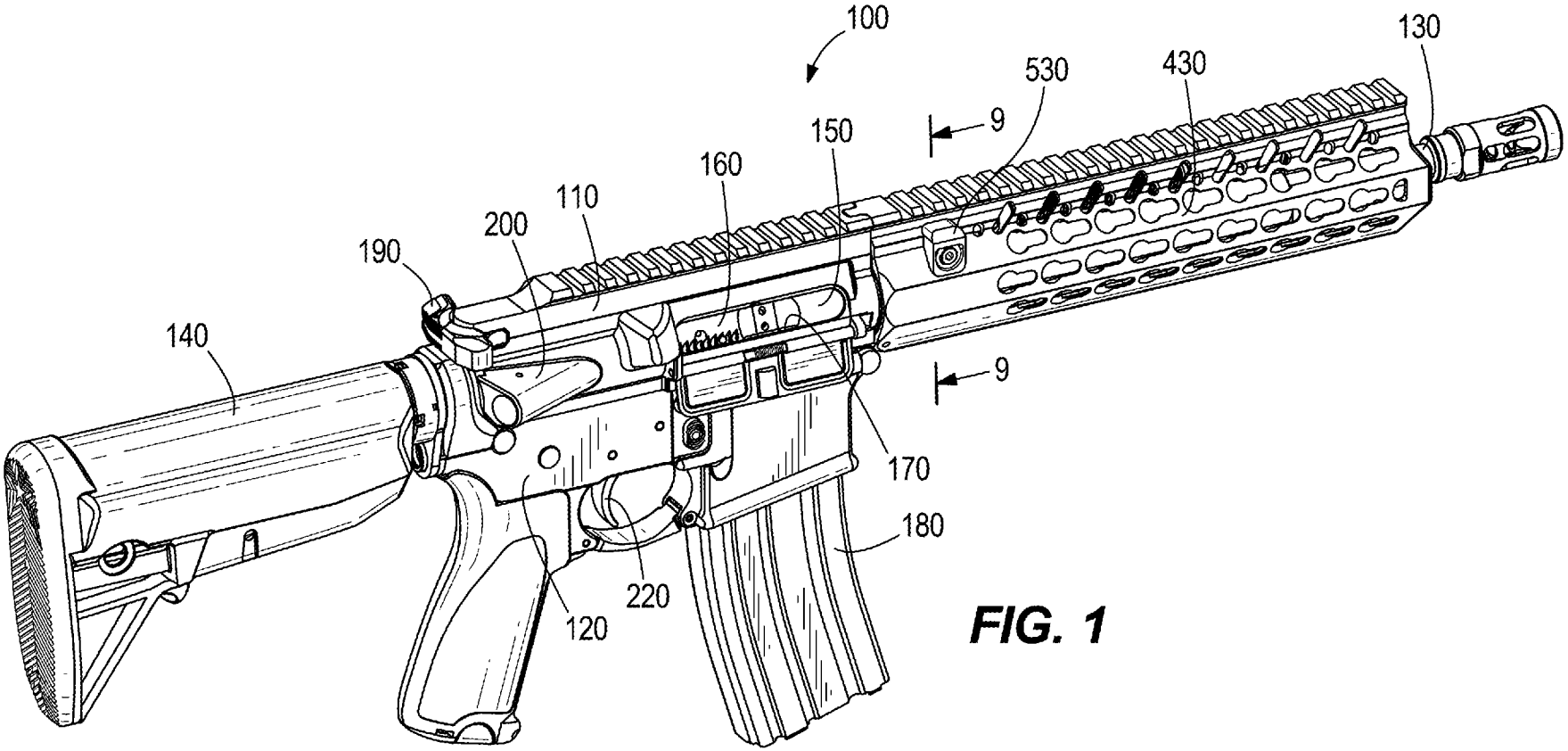
FIG. 1 illustrates an exemplary firearm including an embodiment of the present invention.
Figure 2:
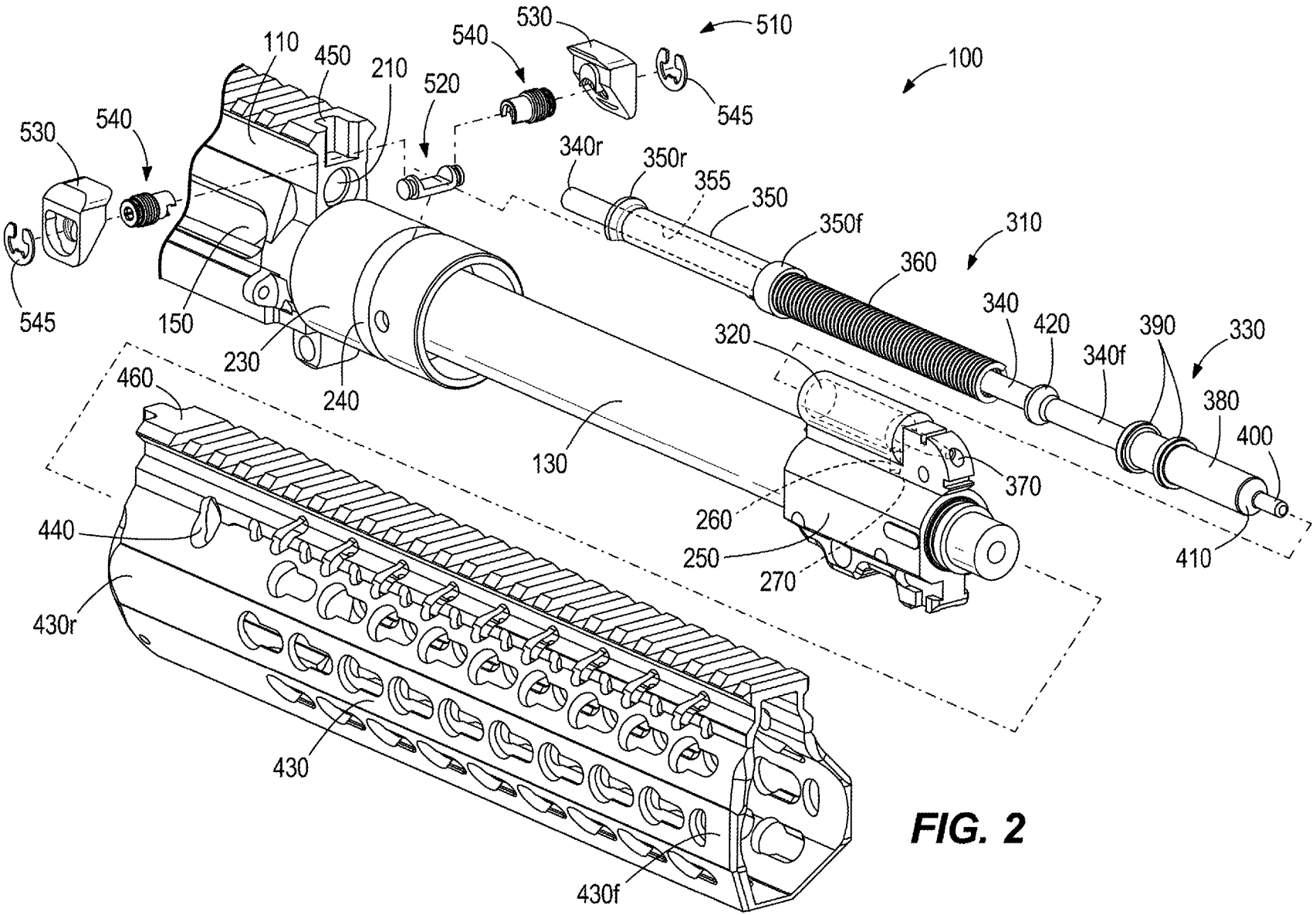
FIG. 2 is an exploded view of a handguard mounting assembly of the firearm.

FIGS. 1 and 2 illustrate an exemplary firearm 100 which may embody the present invention. The illustrated firearm 100 is an AR-15 rifle and includes an upper receiver 110, a lower receiver 120, a barrel 130, and a buttstock 140. The buttstock 140 defines the back or rear of the firearm 100 and the barrel 130 defines the front of the firearm 100. For the purposes of this disclosure, the terms "front," "forward" and their variations (e.g., "forwardly") mean in a direction toward the distal end of the barrel 130 and the term "rearward" and its variations (e.g., "rearwardly") mean in a direction toward the distal end of the buttstock 140. To avoid crowding in the figures, reference numbers are not always included for front and rear portions of individual elements but will be understood by those of ordinary skill in the art based on the foregoing definitions and when read in context with other elements for which front and rear reference numbers are provided.

The upper receiver 110 defines a chamber 150 in which a bolt carrier 160 reciprocates to expel a spent round out of an ejection window 170 and introduce a new round from a magazine 180 into the chamber 150 so that the firearm 100 is ready to be fired again. The reciprocation of the bolt carrier 160 and the motive force behind the reciprocation is often referred to as the self-loading action, or simply the action, of the firearm 100. Generally, the action of the firearm 100 includes a motive force that drives the bolt carrier 160 rearwardly and an action spring that is compressed by the rearward motion of the bolt carrier 160 to develop a forward biasing force. The action spring is often housed in the buttstock 140. After the bolt carrier 160 has been driven rearward by the motive force, the biasing force in the action spring drives the bolt carrier 160 forward to chamber a new round and position the bolt carrier 160 for firing.

The upper receiver 110 also includes a charging handle 190 which engages the bolt carrier 160 so that the operator may manually draw the bolt carrier 160 rearward to load an initial round into the chamber 150. When the charging handle 190 is released, the biasing force of the action spring, which has been compressed by the rearward motion of the bolt carrier 160, drives the bolt carrier 160 forward to chamber the initial round. The upper receiver 110 also includes a forward assist bore 200 that receives a forward assist assembly (not illustrated) for manually nudging the bolt carrier 160 forward into a firing position in the event the action fails to do so. As seen in FIG. 2, the upper receiver 110 also includes a forward access hole 210. The lower receiver 120 includes a trigger assembly 220 for firing the properly-chambered round.

Referring now to FIG. 2, a barrel nut 230 is threaded onto the front end of the upper receiver 110 to precisely seat and secure the barrel 130. The barrel nut 230 includes an outer surface into which is formed a circumferential channel 240 or cut. The firearm 100 also includes a gas block 250 mounted to the barrel 130 forward of the barrel nut 230. The gas block 250 includes a gas port 260 that communicates with a hole 270 in the barrel 130 wall.

When a round is fired, high-pressure gases in the barrel 130 flow out of the barrel 130 into the gas block 250 through the hole 270 and gas port 260 to operate the self-loading action of the firearm 100. In this regard, the barrel gases are the motive fluid for the action of the firearm 100. The two common types of self-loading actions are direct impingement and gas piston. In a direct impingement action, the barrel gases flow through a tube that communicates between the gas block 250 and the upper receiver 110. The gases directly impinge on a bolt carrier 160 in the upper receiver 110 to drive the bolt carrier 160 rearwardly in the upper receiver 110. In a gas piston action, such as the one illustrated in attached drawings, the barrel gases act on a piston and operating rod which in turn strikes or drives the bolt carrier 160 rearward in the upper receiver 110. Although illustrated with a gas piston self-loading action, the present invention is intended for all systems that could accept a modular rail system, including auto loaders, bolt actions, lever action, single shots, and any other kind of system. The present invention may be used on a rifle, carbine, pistol or a shotgun.

With continued reference to FIG. 2, the gas piston self-loading action includes a piston assembly 310. There are many different configurations of piston assemblies, but the one illustrated is for a standard HK416 upper receiver. The illustrated piston assembly 310 includes a gas cylinder 320, a piston 330, an operating rod 340, a bushing 350, and a return spring 360. The gas cylinder 320 is integrally formed with the gas block 250 and receives the high-pressure barrel gases from the gas port 260. The front of the gas cylinder 320 includes a gas vent hole 370.

The piston 330 is housed for reciprocation in the gas cylinder 320 and includes a cylindrical portion 380, a pair of circumferential flanges 390, a gas limiting valve or nose 400, and a gas impingement surface 410. The cylindrical portion 380 resides in the gas cylinder 320 within close tolerances (i.e., the cylindrical portion 380 has an outer diameter that is only slightly smaller than the inner diameter of the gas cylinder 320) to effectively plug the gas cylinder 320 (i.e., avoid significant gas flow around the cylindrical portion 380 inside the gas cylinder 320). The circumferential flanges 390 are rearward of the cylindrical portion 380 and are positioned outside of the gas cylinder 320. The circumferential flanges 390 provide convenient surfaces for an operator to grasp the piston 330 during assembly and disassembly.

The nose 400 extends forward from the forward end of the cylindrical portion 380 and is of a reduced diameter compared to the diameter of the cylindrical portion 380. The nose 400 fits with close tolerances inside the gas vent hole 370 at the front of the gas cylinder 320 to effectively plug the gas vent hole 370. The gas impingement surface 410 is defined by the exposed front end of the cylindrical portion 380 around the base of the nose 400. The piston assembly 310 generally, and the piston 330 specifically, are in an at-rest position when the piston 330 is fully forward in the gas cylinder 320 with the nose 400 extending into the gas vent hole 370.

The operating rod 340 includes a forward end 340*f* which abuts the rear end of the piston 330 and a rear end 340*r* which abuts a portion of the bolt carrier 160. The operating rod 340 also includes a spring shoulder 420 closer to the forward end 340*f* than to the rear end 340*r*.

Figure 3:
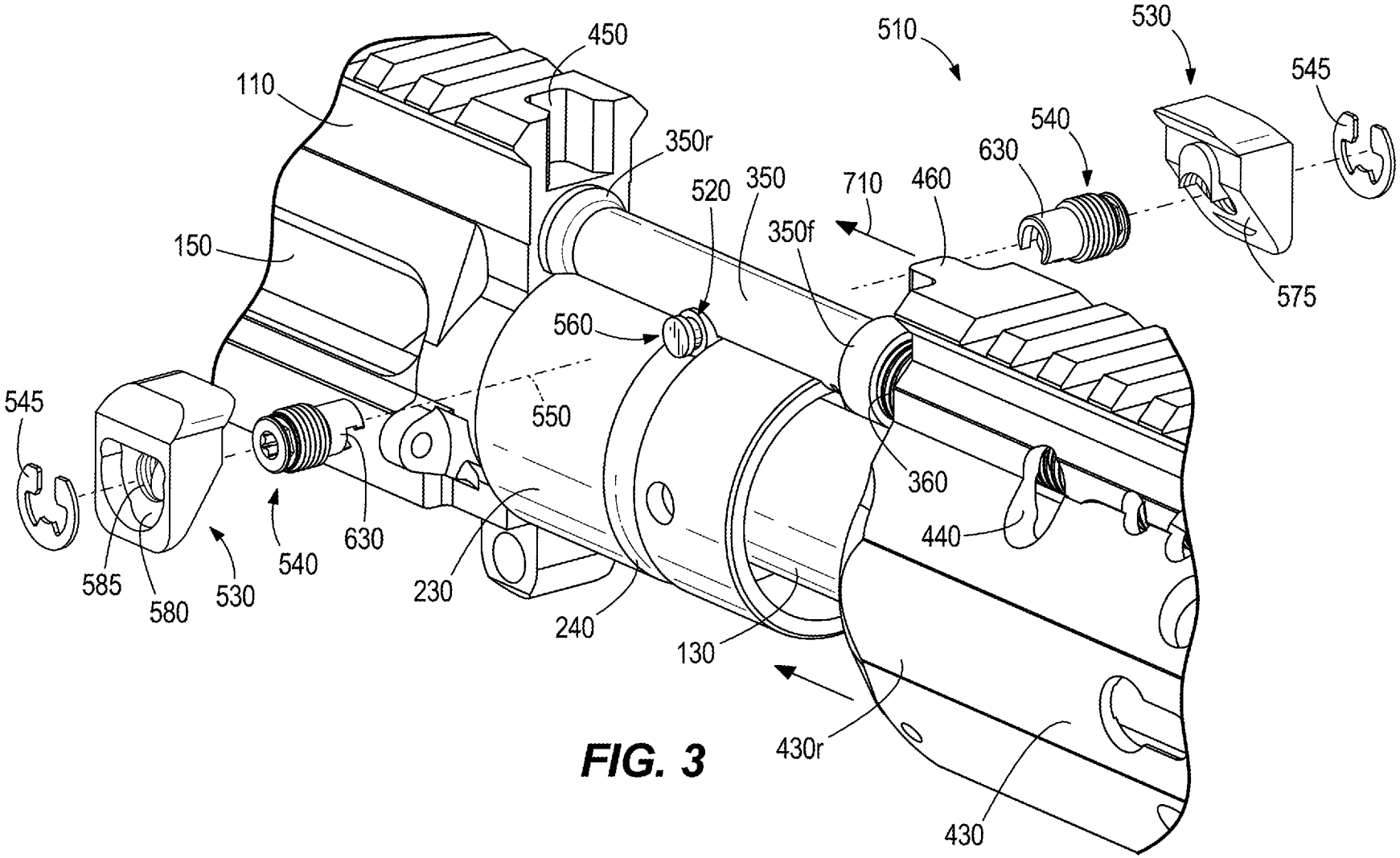
FIG. 3 illustrates a first step in installing the handguard mounting assembly on the firearm.

As seen in FIG. 3, the bushing 350 abuts the upper receiver 110. A rear end 350*r* of the bushing 350 abuts the forward end of the upper receiver 110 and a forward end 350*f* of the bushing 350 defines a spring seat which receives the rear end of the return spring 360. The bushing 350 includes a longitudinal cylindrical bore 355. The bushing 350 includes a downwardly-opening cut-out or window 367 (FIGS. 8 and 9) The rear end 350*r* of the bushing 350 covers the forward access hole 210 of the upper receiver 110 to align the cylindrical bore 355 with the forward access hole 210. The operating rod 340 extends through the cylindrical bore 355 and the forward access hole 210 and is supported by the cylindrical bore 355 for reciprocation about the collinear longitudinal axes of the bore 355 and operating rod 340.

As noted above, the return spring 360 includes a rear end which abuts the spring seat at the forward end 350*f* of the bushing 350. The return spring 360 also includes a forward end which abuts the spring shoulder 420 of the operating rod 340. The return spring 360 compresses between the spring seat 350*f* and the spring shoulder 420 as the operating rod 340 moves rearward. A biasing force develops in the return spring 360 due to this compression, and the biasing force returns the operating rod 340 forward into the at-rest position.

In operation, barrel gases are directed by the gas block 250 into a space between the gas impingement surface 410 of the piston 330 and the forward end of the gas cylinder 320. The barrel gases are under high pressure and expand in the gas cylinder 320 to move the piston 330 rearward. Rearward movement of the piston 330 pushes the operating rod 340 rearward into engagement with the bolt carrier 160. This rearward movement of the piston 330 and operating rod 340 is sudden and quick and results the operating rod 340 striking or pushing the bolt carrier 160 with sufficient force to move the bolt carrier 160 fully rearward in the chamber 150 with sufficient momentum to compress the action spring and cycle the action of the firearm 100. As the piston 330 moves rearward, the nose 400 retracts from the gas vent hole 370 in the gas cylinder 320 such that the gas vent hole 370 is eventually opened. Gas in the cylinder 320 is vented forward through the gas vent hole 370 under pressure remaining in the gas cylinder 320 and as the biasing force of the return spring 360 acting through the operating rod 340 moves the piston 330 forward in the gas cylinder 320.

With continued reference to FIG. 2, a handguard 430 is mounted around the barrel 130 to afford the operator an easily-graspable surface during operation of the firearm 100 and to provide a modular accessory mounting system which may include rails, holes, and slots such as the well-known Picatinny rails, Mlok slots, and KeyMod slots. The illustrated handguard 430 is generally cylindrical (extending fully around the barrel 130), but the invention is equally applicable to non-cylindrical handguards, including handguards that are U-shaped under the barrel 130 and leave the top of the barrel 130 exposed. The handguard 430 includes a rear end 430*r* surrounding the barrel nut 230 and a front end 430*f*. The handguard 430 may cover the gas block 250. The handguard 430 also includes a pair of mounting apertures 440, one on each side of the rear end 430*r*. The mounting apertures 440 align with each other over the barrel nut 230. The forward end of the upper receiver 110 and the rear end 430*r* of the handguard 430 have respective mating features 450, 460 to clock or align the handguard 430 with respect to the upper receiver 110 such that the respective Picatinny rails align. The mating features 450, 460 resist rotation of the handguard 430 on the barrel nut 230.

Figure 6:
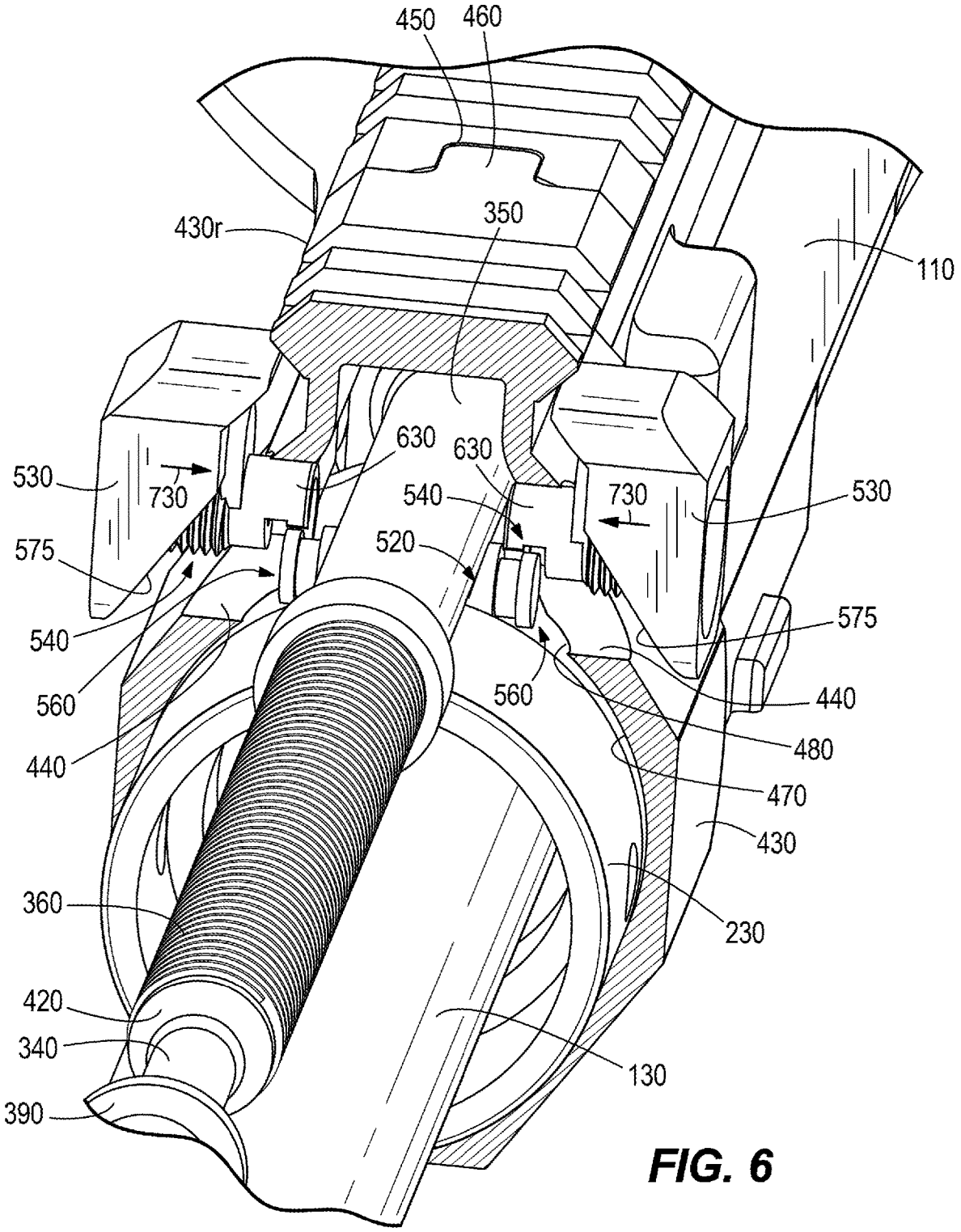
FIG. 6 illustrates a second step in installing the handguard mounting assembly on the firearm.
Figure 7:
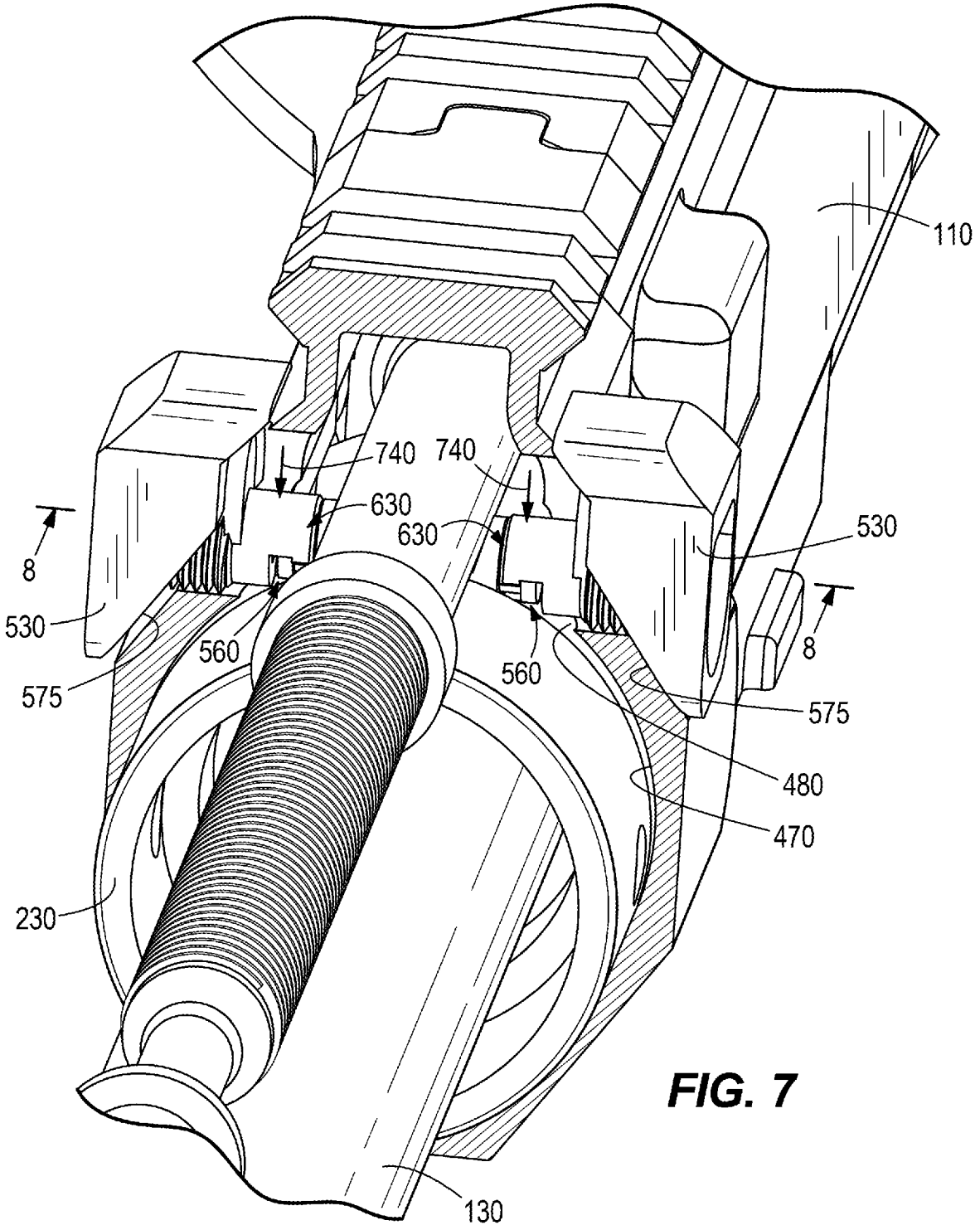
FIG. 7 illustrates a third step in installing the handguard mounting assembly on the firearm.
Figure 8:
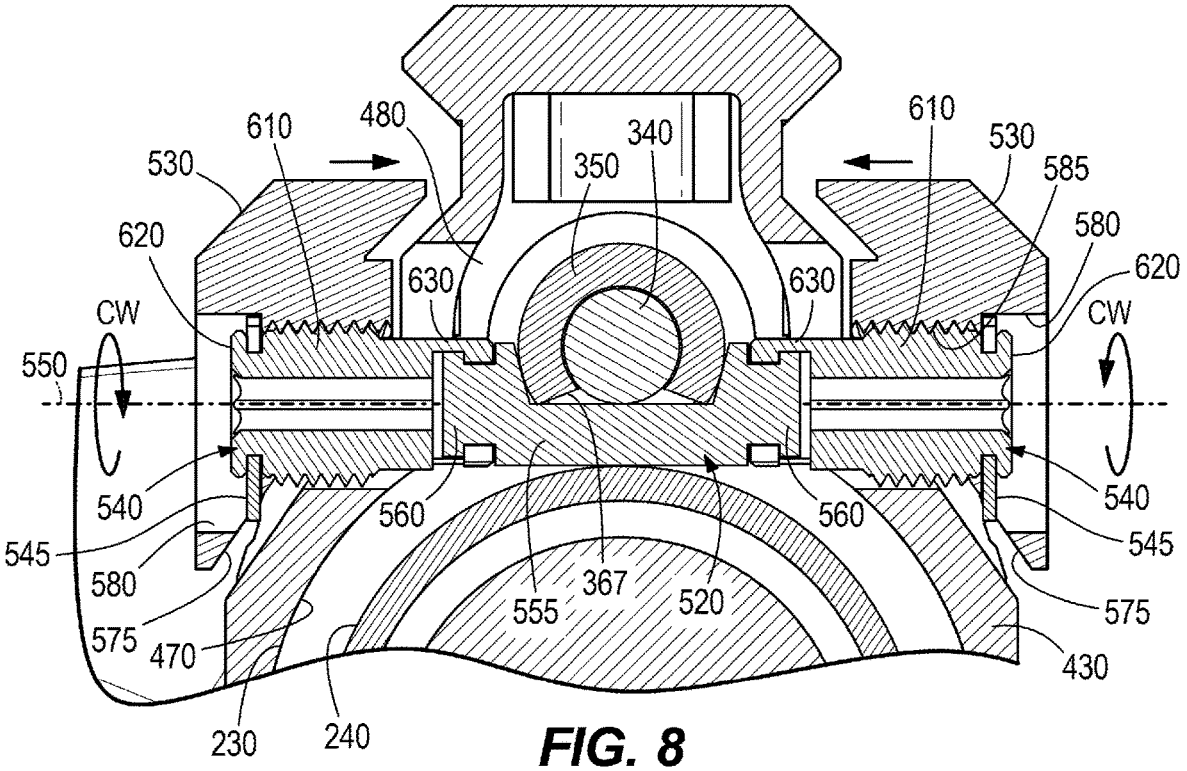
FIG. 8 is a cross-sectional view taken along line 8-8 in FIG. 7 illustrating a fourth step in installing the handguard mounting assembly on the firearm.

Referring briefly to FIGS. 6-8, the rear end 430*r* defines an internal clamping surface 470 facing the barrel nut 230 and a gap 480 above the barrel nut 230. When the gap 480 is made smaller, the clamping surface 470 moves radially inward to clamp onto the barrel nut 230. The gap may be provided under a Picatinny rail of the illustrated handguard 430. Alternatively, the invention will work for handguards having a non-tubular rail system and handguards having an open top or "U" shape. The concept of the present invention is therefore applicable to firearms other than the AR-15 series.

As best illustrated in FIGS. 2-5, the firearm 100 includes a handguard mounting assembly 510 for mounting the rear end 430*r* of the handguard 430 to the barrel nut 230. The handguard 430 extends in cantilever fashion over the barrel 130 forward of the barrel nut 230. The handguard mounting assembly 510 includes a tie rod 520, left and right identical clamp blocks 530, left and right identical fasteners 540, and left and right E-clips 545.

Figure 4:
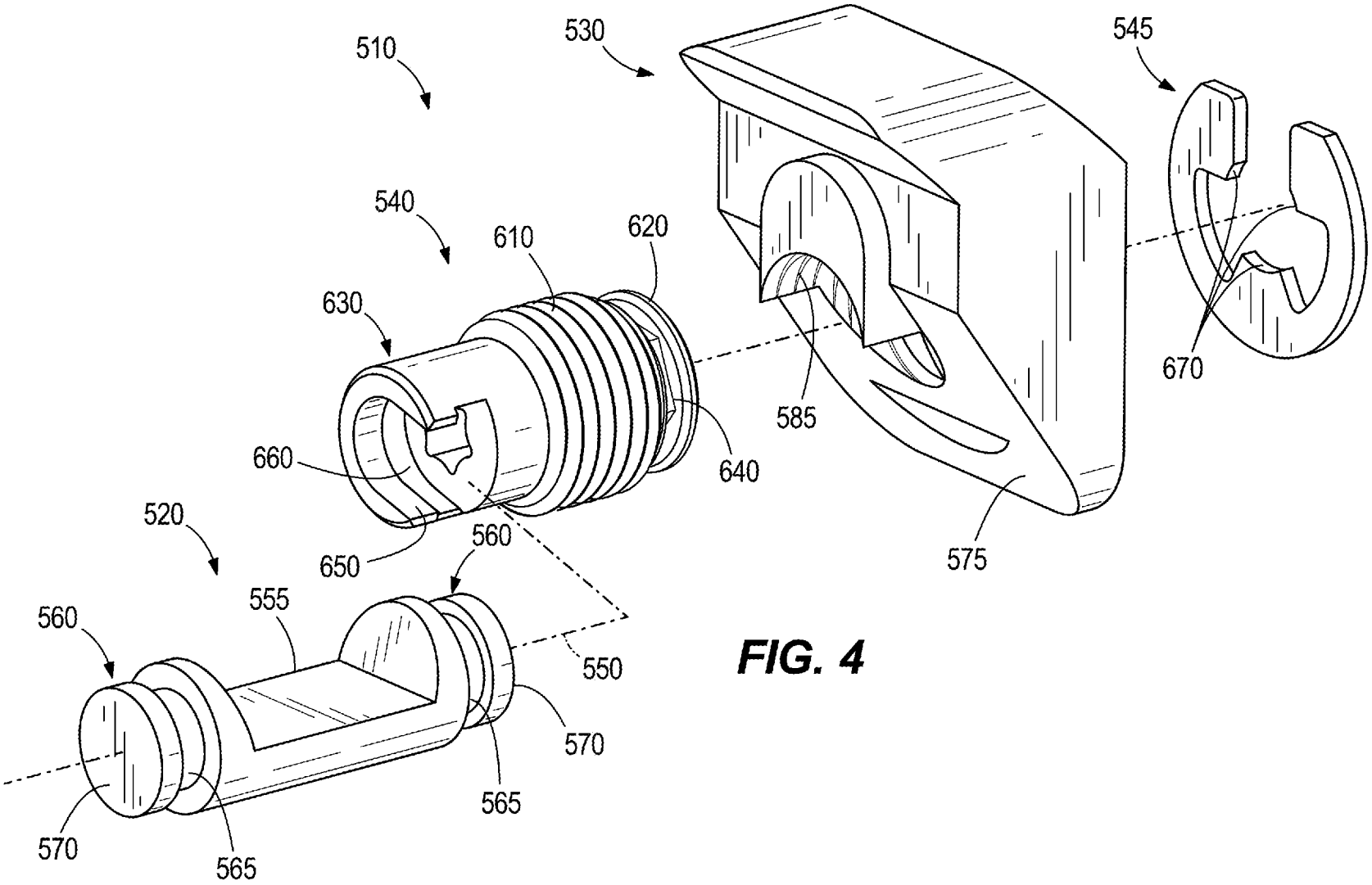
FIG. 4 is an exploded view of components of the handguard mounting assembly from a first perspective.

Referring to FIG. 4, the tie rod 520 is generally cylindrical and defines a longitudinal axis 550 which may be referred to as a clamping axis for the mounting assembly 510. The tie rod 520 includes a middle portion 555 having a low profile (e.g., hemi-cylindrical or reduced thickness) and opposite ends that define tie rod connectors 560. The tie rod connectors 560 each include a circumferential cut 565 which results in a reduced diameter portion at each end of the tie rod 520 and a button-like end 570 between the cut 565 and the distal end of the tie rod 520.

Figure 5:
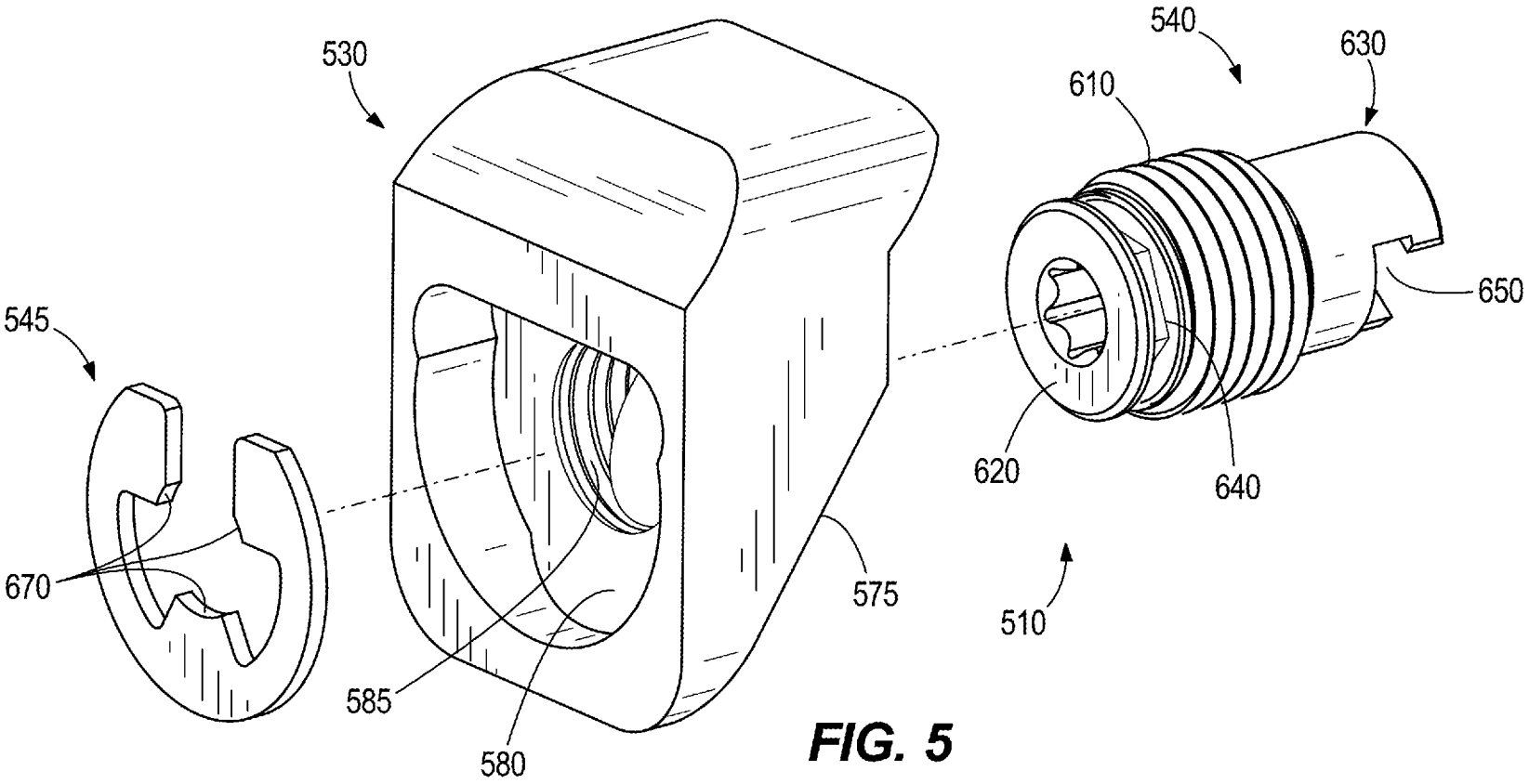
FIG. 5 is an exploded view of components of the handguard mounting assembly from a second perspective.

With reference to FIGS. 4-5, each clamp block 530 includes a clamping surface 575 that engages the outer surface of the handguard 430. A recess 580 in the outer surface of the clamp block 530 includes a countersunk threaded hole 585 that extends through to the clamping surface 575. An associated fastener 540 is threaded into each threaded hole 585. The threaded hole 585 has left-hand threads as will be discussed below.

Each fastener 540 is associated with one of the clamp blocks 530 and includes a threaded portion 610 that threads into the threaded hole 585, a drive end 620 for receiving a tool to turn the fastener 540, and a fastener connector 630 for engaging one of the tie rod connectors 560. The threaded portion 610 has left-hand threads as will be explained in more detail below. The drive end 620 may include any suitable tool interface such as a hex head for a socket, a slot or cross for a flat-head or Philips-head screwdriver, or the illustrated star pattern for a T15 TORX® interface. The drive end 620 includes a hex cut 640 which defines six flats around the circumference of the drive end 620, onto which the E-clips 545 are snapped. In other configurations, there may be more or fewer than six flats around the drive end 620. The fastener connectors 630 include a slot 650 through which the reduced-diameter portion of the tie rod 520 can pass and a pocket 660 which receives the button-like end 570 of the tie rod 520. An inner surface of each pocket 660 engages one of the button-like ends 570 of the tie rod connector 560 so that the fasteners 540 can pull on the tie rod 520 along the clamping axis 550 from opposite ends. In this regard, the pockets 660 can alternatively be referred to as undercuts.

Each E-clip 545 includes a plurality of flats 670 which engage the associated flats when the E-clips 545 are snapped over the hex cuts 640. Each E-clip 545 is positioned within the recess 580 in the clamp blocks 530 with an anti-rotational feature to prevent rotation of the E-clip 545. For example, the E-clip 545 may have a non-circular outer shape that cannot rotate within a non-circular recess 580. The E-clips 545 provide positive locking for the fasteners 540, meaning that the E-clips 545 act as detents for the fasteners 540. The term detent means that the restraining force operating on the detent (e.g., the engagement of the E-clips 545 on the hex cuts 640) can be overridden with a desired level of force (e.g., a desired torque applied to the fastener 540) and snap back into engagement on the next detent without breaking any components in the assembly. The E-clips 545 resist rotation of the fasteners 540 with respect to the clamp blocks 530 unless sufficient torque is applied to the fasteners. When sufficient torque is applied, the E-clips provide audible and tactile feedback to the operator each time the E-clip snaps onto the next detent, which gives the operator an indication of how far the fasteners 540 have been rotated. Additionally, the E-clips 545 help retain the fasteners 540 in the clamp blocks 530 during assembly and disassembly.

The clamp blocks 530, fasteners 540, and E-clips 545 can be referred to as a clamping subassembly. As already noted, the threads of the threaded portions 610 and the threads of the threaded holes 585 are left handed, which means that counterclockwise rotation of the fasteners 540 (as viewed from the drive end 620) advances the fasteners 540 into the threaded holes 585 and clockwise rotation backs the fasteners 540 out of the threaded holes 585 (i.e., away from the handguard 430).

Figure 9:
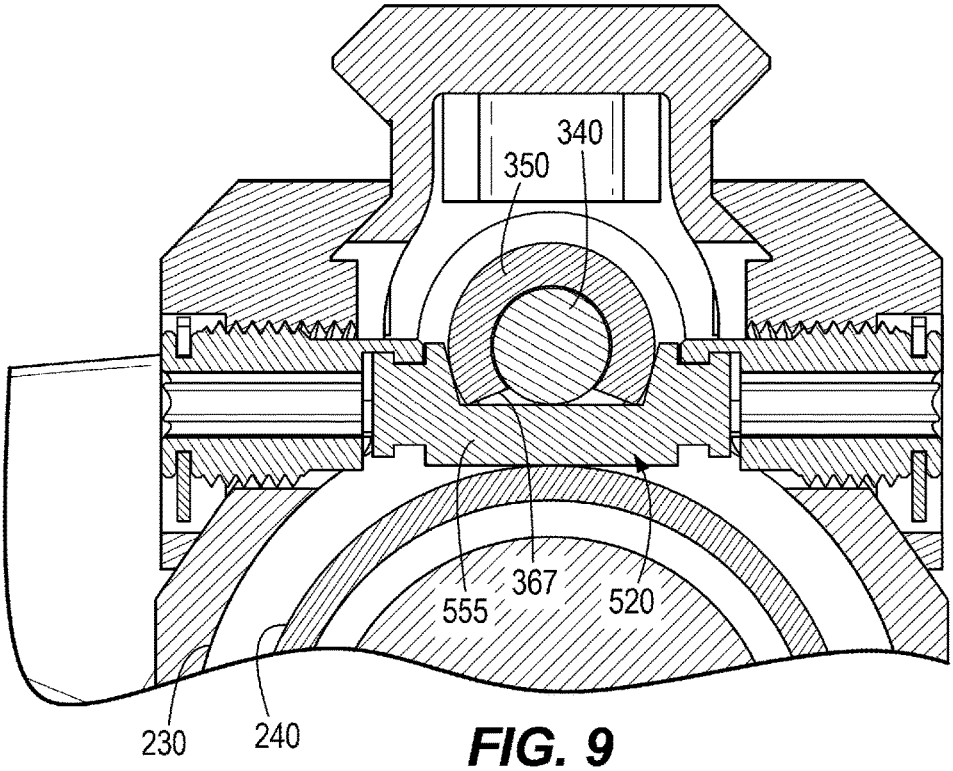
FIG. 9 is a cross-sectional view taken along line 9-9 in FIG. 1 illustrating the handguard mounting assembly fully installed on the firearm.

FIGS. 6-8 illustrate a sequence of steps for using the handguard mounting assembly 510 to secure the rear end **430*r* of the handguard 430 to the barrel nut 230. As illustrated in FIGS. 8 and 9, the middle portion 555 of the tie rod 520 is positioned in the channel 240 of the barrel nut 230. The bushing 350 is positioned across (perpendicular to) the middle portion 555 of the tie rod 520, with middle portion 555 extending across the window 367 in the bushing 350. The tie rod 520 extends along the clamping axis 550 across the gap 480 in the handguard 430**.

The operating rod 340 also extends perpendicular to the tie rod 520. The tie rod 520 is therefore positioned between the barrel nut 230 and the operating rod 340, with the middle portion 555 extending at least partially around a portion of the operating rod 340. The top of the middle portion 555 is about flush with the outer surface of the barrel nut 230. This places the middle portion 555 in close proximity to the operating rod 340 to minimize the height of the assembly. The combination of the channel 240, low-profile reduced thickness configuration of the middle portion 555, and the window 367 in the bushing 350 provides clearance for the operating rod 340 to extend over the top of the barrel nut 230 with only a tiny spacing between the operating rod 340 and the barrel nut 230.

With reference to FIG. 2, the tie rod 520 is positioned between the operating rod 340 and the barrel nut 230 with the tie rod connectors 560 accessible on opposite sides of the bushing 350. The tie rod 520 extends along the clamping axis 550. The handguard 430 is moved rearwardly (as indicated with arrow 710) to place the rear end **430*r* into abutment with the front end of the upper receiver 110, with the mating features 450, 460 engaging. When the rear end 430*r* abuts the upper receiver 110, the mounting apertures 440 align with the tie rod connectors 560**.

Turning to FIG. 6, the clamp block subassemblies (i.e., each subassembly having a clamp block 530, a fastener 540, and an E-clip 545) are brought in from opposite sides, as indicated with arrows 730. In this position, the fastener connectors 630 are positioned over the tie rod connectors 560 and the clamping surface 575 of each clamp block 530 is proximate the outer surface of the handguard 430 over the mounting apertures 440.

With reference now to FIG. 7, the fastener connectors 630 are lowed (or otherwise moved radially with respect to the clamping axis 550) in the direction of arrows 740 onto the tie rod connectors 560 so that the cut 565 of each tie rod connector 560 is received in the slot 650 of an associated fastener connector 630 and the button-like ends 570 of the tie rod connectors 560 are received or captured in the pocket 660 of the respective tie rod connectors 560. In this step, the first and second ends of the tie rod 520 (i.e., the tie rod connectors 560) are secured to the handguard 430 on the first and second sides of the gap 480.

Referring now to FIG. 8, the fasteners 540 are turned with a tool clockwise (as viewed from the drive end 620) to back the fasteners 540 out of the clamp blocks 530. Rotation of the fasteners 540 with respect to the clamp blocks 530 is confirmed with clicking from the detent interaction of the E-clips 545 with the hex cuts 640 on the fasteners 540. The engagement between the fastener connectors 630 and the tie rod connectors 560 permits relative rotation of the fasteners 540 with respect to the tie rod 520 about the clamping axis 550 without imparting torque to the tie rod 520, but the engagement resists relative movement between the fastener 540 and tie rod 520 along the clamping axis 550.

As the fasteners 540 are turned clockwise with respect to the clamp blocks 530, the clamp blocks 530 are drawn toward the handguard 430 from opposite sides in a clamping action. Eventually the clamping surface 575 of each clamp block 530 comes into engagement with the outer surface of the handguard 430 and a clamping (compressive) load is applied to the handguard 430 across the gap 480. Although the fasteners 540 are left-hand threaded, the clamping assembly 510 uses a conventional clockwise rotation of the fastener 540 (from the drive end 620) to tighten the clamping force ("righty-tighty") and counterclockwise rotation to loosen the clamping force. As the gap 480 narrows, the clamping surface 470 of the handguard 430 tightens radially onto the barrel nut 230. A reactive tensile load is borne by the tie rod 520 in response to the clamping load on the handguard 430 and barrel nut 230. The tensile load acts along the clamping axis 550. The load path for the compressive and reactive tensile load goes from the barrel nut 230 through the wall of the handguard 430, to the clamp block 530, to the fasteners 540 (through the threaded engagement of the threaded portions 610 and the threaded holes 585), to the tie rod 520 (through the engagement of the fastener connectors 630 and the tie rod connectors 560).

An alternative configuration of the handguard mounting assembly 510 could include a connector in one side of the handguard 430 or in one of the clamp blocks 530 so that one end of the tie rod 520 connects directly to handguard 430 or the clamp block 530 on one side of the assembly. In such a configuration, a single fastener 540 would be used on the opposite side of the assembly to connect to the opposite end of the tie rod 520. With this configuration, only one fastener 540 would be employed and the clamping force (i.e., narrowing of the gap 480) would be applied by rotating the single fastener 540.

Thus, the invention provides, among other things, a handguard mounting system that utilizes a low-profile tie rod particularly useful on a firearm using a gas piston action. Various features and advantages of the invention are set forth in the following claims.

What is claimed is:

1. A mounting assembly for a handguard mounted on a barrel nut of a firearm having a gas piston action that includes an operating rod, the handguard including a clamping surface engaging an outer surface of the barrel nut and defining a gap, the operating rod extending through the gap, the mounting assembly comprising:

a tie rod extending along a clamping axis across the gap, the tie rod including a middle portion between the operating rod and the barrel nut, a first end defining a tie rod connector proximate a first side of the gap, and a second end secured to the handguard on a second side of the gap opposite the first side;

a clamp block having a clamping surface engaging an outer surface of the handguard; and a fastener threaded into a threaded bore of the clamp block and including a fastener connector engaging the tie rod connector, the engagement of the tie rod connector and fastener connector permitting relative rotation between the fastener and tie rod about the clamping axis without causing movement between the fastener and tie rod along the clamping axis;

wherein rotation of the fastener in the threaded bore draws the second end of the tie rod toward the clamp block to narrow the gap and clamp the clamping surface of the handguard against the barrel nut.

2. The mounting assembly of claim 1, wherein the operating rod extends perpendicular to the tie rod; and the tie rod middle portion extends at least partially around a portion of the operating rod.

3. The mounting assembly of claim 1, wherein the piston extends perpendicular to the tie rod; and the tie rod middle portion includes a reduced thickness portion to accommodate the piston.

4. The mounting assembly of claim 1, wherein one of the tie rod connector and fastener connector includes a cup and the other of the tie rod connector and fastener connector includes a portion captured in the cup.

5. The mounting assembly of claim 1, wherein a clamping force of the clamping surface against the barrel nut gives rise to a reactive tensile load on the tie rod.

6. The mounting assembly of claim 1, wherein the fastener is threaded into the clamp block with left-hand threads.

7. The mounting assembly of claim 1, wherein the fastener and clamp block are a respective first fastener and first clamp block, the mounting assembly further comprising a second fastener and second clamp block for securing the second end of the tie rod to the handguard on the second side of the gap.

8. A handguard assembly for a firearm having a barrel nut and an operating rod for cycling an action of the firearm, the handguard assembly comprising:

a handguard including a clamping surface engaging a majority of an outer circumference of the barrel nut and defining a gap through which the operating rod extends;

a tie rod extending along a clamping axis across the gap, the tie rod including a middle portion between the operating rod and the barrel nut, a first end defining a tie rod connector proximate a first side of the gap, and a second end secured to the handguard on a second side of the gap opposite the first side;

a clamp block having a clamping surface engaging an outer surface of the handguard; and a fastener threaded into a threaded bore of the clamp block and including a fastener connector engaging the tie rod connector, the engagement of the tie rod connector and fastener connector permitting relative rotation between the fastener and tie rod about the clamping axis without causing movement between the fastener and tie rod along the clamping axis;

wherein rotation of the fastener in the threaded bore draws the second end of the tie rod toward the clamp block to narrow the gap and clamp the clamping surface of the handguard against the barrel nut.

9. The handguard assembly of claim 8, wherein the operating rod extends perpendicular to the tie rod; and the tie rod middle portion extends at least partially around a portion of the operating rod.

10. The handguard assembly of claim 1, wherein the operating rod extends perpendicular to the tie rod; and the tie rod middle portion includes a reduced thickness portion to accommodate the operating rod.

11. The handguard assembly of claim 8, wherein one of the tie rod connector and fastener connector includes a cup and the other of the tie rod connector and fastener connector includes a portion captured in the cup.

12. The handguard assembly of claim 8, wherein a clamping force of the clamping surface against the barrel nut gives rise to a reactive tensile load on the tie rod.

13. The handguard assembly of claim 8, wherein the fastener is threaded into the clamp block with left-hand threads.

14. The handguard assembly of claim 8, wherein the fastener and clamp block are a respective first fastener and first clamp block, the mounting assembly further comprising a second fastener and second clamp block for securing the second end of the tie rod to the handguard on the second side of the gap.

15. A method for mounting a handguard assembly to a firearm having a barrel nut and an operating rod for cycling an action of the firearm, the method comprising the steps of:

positioning a clamping surface of the handguard assembly against an outer circumference of the barrel nut and defining a gap through which the operating rod extends;

extending a tie rod along a clamping axis across the gap with a middle portion of the tie rod between the operating rod and the barrel nut;

defining a tie rod connector at a first end of the tie rod and proximate a first side of the gap;

securing a second end of the tie rod to a second side of the gap opposite the first side;

positioning a clamp block against an outer surface of the handguard adjacent the first side of the gap;

threading a fastener into a threaded bore of the clamp block, the fastener including a fastener connector engaging the tie rod connector to permit relative rotation between the fastener and tie rod about the clamping axis without causing movement between the fastener and tie rod along the clamping axis; and in response to rotation of the fastener in the threaded bore, drawing the second end of the tie rod toward the clamp block to narrow the gap and clamp the clamping surface of the handguard against the barrel nut.

16. The method of claim 15, wherein the operating rod extends perpendicular to the tie rod, the step of extending the tie rod including extending a middle portion at least partially around a portion of the operating rod.

17. The method of claim 15, wherein one of the tie rod connector and fastener connector includes a cup and the other of the tie rod connector and fastener connector includes a portion captured in the cup; the step of threading a fastener into the clamp block including engaging the cup with the portion captured in the cup.

18. The method of claim 15, further comprising the step of generating a reactive tensile load on the tie rod in response to drawing the second end of the tie rod toward the clamp block, and maintaining a clamping force of the clamping surface against the barrel nut by bearing the tensile load with the tie rod.

19. The method of claim 15, wherein the step of threading a fastener comprises threading the fastener into the clamp block with left-hand threads.

20. The method of claim 15, further comprising the steps of securing the second end of the tie rod to the handguard on the second side of the gap with a second fastener and second clamp block.

* * * * *